US008479322B2

(12) United States Patent
Blackford et al.

(10) Patent No.: US 8,479,322 B2
(45) Date of Patent: Jul. 9, 2013

(54) ZONED FUNCTIONAL FABRICS

(75) Inventors: Michael E. "Woody" Blackford, Portland, OR (US); Jeffrey Mergy, Portland, OR (US)

(73) Assignee: Columbia Sportswear North America, Inc., Portland, OR (US)

( * ) Notice: Subject to any disclaimer, the term of this patent is extended or adjusted under 35 U.S.C. 154(b) by 0 days.

(21) Appl. No.: 13/243,992

(22) Filed: Sep. 23, 2011

(65) Prior Publication Data

US 2012/0015155 A1 Jan. 19, 2012

Related U.S. Application Data

(63) Continuation-in-part of application No. 13/101,021, filed on May 4, 2011, which is a continuation-in-part of application No. 12/776,306, filed on May 7, 2010, application No. 13/243,992, filed on Sep. 23, 2011, which is a continuation-in-part of application No. 29/385,768, filed on Feb. 18, 2011, now Pat. No. Des. 670,917, and a continuation-in-part of application No. 29/360,364, filed on Apr. 23, 2010, now Pat. No. Des. 670,435, and a continuation-in-part of application No. 29/346,787, filed on Nov. 5, 2009, now Pat. No. Des. 655,921, and a continuation-in-part of application No. 29/346,784, filed on Nov. 5, 2009, now Pat. No. Des. 656,741, and a continuation-in-part of application No. 29/346,785, filed on Nov. 5, 2009, now Pat. No. Des. 653,400, and a continuation-in-part of application No. 29/346,786, filed on Nov. 5, 2009, now Pat. No. Des. 657,093, and a continuation-in-part of application No. 29/346,788, filed on Nov. 5, 2009, now Pat. No. Des. 651,352, and a continuation of application No. 29/336,730, filed on May 7, 2009, now Pat. No. Des. 650,529.

(60) Provisional application No. 61/176,448, filed on May 7, 2009.

(51) Int. Cl.

| | |
|---|---|
| ***A41D 27/02*** | (2006.01) |
| ***A62B 17/00*** | (2006.01) |
| *A41D 13/01* | (2006.01) |
| *A41D 31/02* | (2006.01) |

(52) U.S. Cl.
USPC ..... 2/456; 2/457; 2/81; 2/82; 2/97; 2/272

(58) Field of Classification Search
USPC ..... 2/455, 456, 457, 458, 7, 81, 82, 97, 2/164, 167, 272, 905, 906
See application file for complete search history.

(56) References Cited

U.S. PATENT DOCUMENTS

| | | | |
|---|---|---|---|
| 2,695,895 | A | 11/1954 | Barnard et al. |
| 2,759,522 | A | 8/1956 | Limm et al. |

(Continued)

FOREIGN PATENT DOCUMENTS

| | | |
|---|---|---|
| DE | 9409799 | 4/1995 |
| EP | 0917888 | 5/1999 |

(Continued)

OTHER PUBLICATIONS

Quelle Catalog: RU, Jacket Advertisement, 2005.

(Continued)

*Primary Examiner* — Bobby Muromoto, Jr.
(74) *Attorney, Agent, or Firm* — Schwabe, Williamson & Wyatt, P.C.

(57) ABSTRACT

Embodiments relate to body gear having designed performance characteristics, and in particular to methods and apparatuses that utilize an array of performance characteristic elements coupled to a base material to direct heat, absorb heat, emit heat, and/or wick moisture while also maintaining the desired transfer properties of the base material. In some embodiments, two, three, four, or more different types of performance characteristic elements may be included in a piece of body gear, for example in desired zones of the body gear.

22 Claims, 10 Drawing Sheets

U.S. PATENT DOCUMENTS

| | | | | |
|---|---|---|---|---|
| 3,577,305 | A | 5/1971 | Hines et al. | |
| 3,663,182 | A * | 5/1972 | Hamling | 442/181 |
| 3,849,802 | A * | 11/1974 | Govaars | 2/81 |
| 4,032,681 | A * | 6/1977 | Jonnes | 442/317 |
| 4,211,261 | A * | 7/1980 | Mehta et al. | 139/425 R |
| 4,395,455 | A * | 7/1983 | Frankosky | 428/332 |
| 4,420,521 | A | 12/1983 | Carr | |
| 4,435,442 | A * | 3/1984 | Hefele | 427/465 |
| 4,463,464 | A * | 8/1984 | Bost et al. | 297/452.61 |
| 4,483,021 | A * | 11/1984 | McCall | 2/7 |
| 4,525,406 | A | 6/1985 | Pollock | |
| 4,569,088 | A * | 2/1986 | Frankenburg et al. | 2/81 |
| 4,569,874 | A | 2/1986 | Kuznetz | |
| 4,622,253 | A * | 11/1986 | Levy | 428/91 |
| 4,637,947 | A * | 1/1987 | Maekawa et al. | 428/68 |
| 4,712,609 | A * | 12/1987 | Iversen | 165/80.4 |
| 4,765,323 | A | 8/1988 | Poettgen | |
| 4,856,294 | A | 8/1989 | Scaringe et al. | |
| 4,912,778 | A | 4/1990 | Daniels | |
| 5,098,795 | A * | 3/1992 | Webb et al. | 428/594 |
| 5,207,852 | A | 5/1993 | Lightle et al. | |
| 5,415,222 | A | 5/1995 | Colvin | |
| 5,860,163 | A | 1/1999 | Aldridge | |
| 6,009,560 | A | 1/2000 | McKenney et al. | |
| 6,110,558 | A | 8/2000 | Billingsley et al. | |
| 6,191,056 | B1 * | 2/2001 | Vogt et al. | 442/148 |
| 6,242,369 | B1 * | 6/2001 | Vogt et al. | 442/148 |
| 6,319,599 | B1 | 11/2001 | Buckley | |
| 6,321,386 | B1 * | 11/2001 | Monica | 2/7 |
| 6,341,384 | B1 * | 1/2002 | Hayes | 2/458 |
| 6,427,242 | B1 | 8/2002 | Bush et al. | |
| 6,511,929 | B1 * | 1/2003 | Vogt et al. | 442/228 |
| 6,591,560 | B2 | 7/2003 | Burke, III et al. | |
| 6,824,819 | B2 * | 11/2004 | Vogt et al. | 427/203 |
| 6,855,410 | B2 | 2/2005 | Buckley | |
| 6,858,068 | B2 * | 2/2005 | Smith et al. | 96/127 |
| 6,874,336 | B2 * | 4/2005 | Yarborough et al. | 66/174 |
| 6,934,985 | B2 | 8/2005 | Sanders | |
| 7,399,919 | B2 * | 7/2008 | McCutcheon et al. | 174/16.3 |
| 7,452,833 | B2 | 11/2008 | Russell et al. | |
| 7,600,269 | B2 | 10/2009 | Feduzi et al. | |
| 7,739,749 | B2 | 6/2010 | Grilliot et al. | |
| 2002/0073481 | A1 | 6/2002 | Creagan et al. | |
| 2003/0027476 | A1 * | 2/2003 | Vogt et al. | 442/380 |
| 2004/0128747 | A1 | 7/2004 | Bumbarger et al. | |
| 2004/0261465 | A1 * | 12/2004 | Yarborough et al. | 66/169 R |
| 2005/0009429 | A1 | 1/2005 | Park et al. | |
| 2005/0077618 | A1 * | 4/2005 | McCutcheon et al. | 257/712 |
| 2005/0209663 | A1 * | 9/2005 | Hamilton et al. | 607/108 |
| 2005/0251900 | A1 * | 11/2005 | Harlacker | 2/457 |
| 2005/0252036 | A1 * | 11/2005 | Laska | 36/11.5 |
| 2006/0051559 | A1 | 3/2006 | Sleeman et al. | |
| 2006/0130367 | A1 | 6/2006 | Liu | |
| 2007/0037034 | A1 * | 2/2007 | Fisher et al. | 429/34 |
| 2007/0129767 | A1 * | 6/2007 | Wahlstrand | 607/33 |
| 2007/0267583 | A1 * | 11/2007 | Dodo | 250/493.1 |
| 2007/0267595 | A1 * | 11/2007 | Dodo | 252/67 |
| 2007/0277806 | A1 * | 12/2007 | Dodo | 126/263.02 |
| 2008/0030856 | A1 | 2/2008 | King | |
| 2008/0099188 | A1 * | 5/2008 | Touzov | 165/104.21 |
| 2008/0251062 | A1 * | 10/2008 | Dodo | 126/263.02 |
| 2008/0257333 | A1 * | 10/2008 | Dodo et al. | 126/263.09 |
| 2008/0282455 | A1 * | 11/2008 | Jones et al. | 2/458 |
| 2008/0283038 | A1 * | 11/2008 | Dodo | 126/263.06 |
| 2009/0000610 | A1 * | 1/2009 | Dodo | 126/263.01 |
| 2009/0209155 | A1 * | 8/2009 | Goulet | 442/234 |
| 2009/0258180 | A1 * | 10/2009 | Goulet | 428/72 |
| 2010/0071119 | A1 * | 3/2010 | Thatcher | 2/458 |
| 2010/0107657 | A1 * | 5/2010 | Vistakula | 62/3.5 |
| 2010/0138983 | A1 * | 6/2010 | Kim | 2/458 |
| 2010/0282433 | A1 * | 11/2010 | Blackford | 165/46 |
| 2010/0326710 | A1 | 12/2010 | Zhang | |
| 2011/0020599 | A1 | 1/2011 | Le Roy et al. | |
| 2011/0036282 | A1 | 2/2011 | Cote | |
| 2011/0107771 | A1 * | 5/2011 | Crist et al. | 62/3.3 |
| 2011/0135899 | A1 * | 6/2011 | Meltzer et al. | 428/217 |
| 2011/0138523 | A1 * | 6/2011 | Layson et al. | 2/458 |
| 2011/0160691 | A1 | 6/2011 | Ng et al. | |
| 2011/0203783 | A1 * | 8/2011 | Blackford et al. | 165/185 |
| 2011/0214221 | A1 * | 9/2011 | Munda | 2/161.1 |

FOREIGN PATENT DOCUMENTS

| | | |
|---|---|---|
| GB | 2073613 A | 10/1981 |
| GB | 2294426 | 5/1996 |
| GB | 2414960 | 12/2005 |
| JP | 63-139147 | 9/1988 |
| JP | 63-125525 | 8/1998 |
| JP | 2004338169 | 12/2004 |
| JP | 2008089863 | 4/2008 |
| KR | 10-2007-0052303 | 5/2007 |
| KR | 30560581 | 5/2010 |
| WO | 9749552 | 12/1997 |
| WO | 0259414 A2 | 1/2002 |
| WO | DM/064488 | 5/2003 |
| WO | DM/064044 | 7/2003 |
| WO | 2006/030254 | 3/2006 |
| WO | DM/067876 | 5/2006 |

OTHER PUBLICATIONS

Sunmore, Poe Yoga Mat, Sporting Goods Buyer's Guide, Spring 2008.

YPCYC Catalog, Kompendium: Sportmode, kettenwirk-praxis, Obertshaunsen, 2006.

Castelli Insolito Radiation Jacket—3 Season Cycling Jacket; www.feedthegabit.com/road-biking/castelli-insolito-radiation-jacket-3-season-cycling-jacket/; Sep. 19, 2008.

Castelli Radiation Jacket www.cyclingweekly.co.uk/archive/tech/322622/castelli-radiation-jacket-300.html; Mar. 10, 2009.

* cited by examiner

FIG. 1A
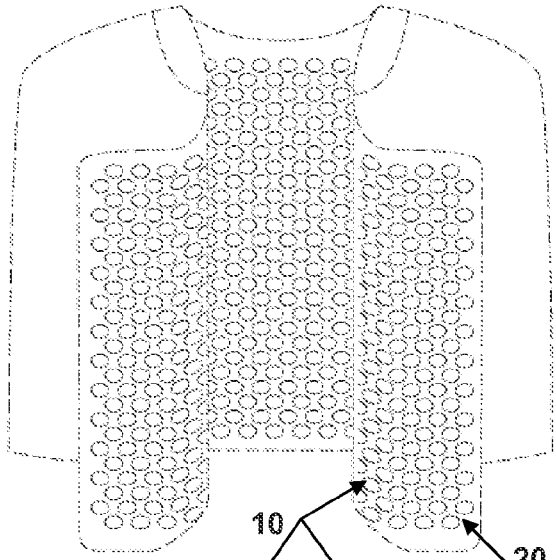
FIG. 1B
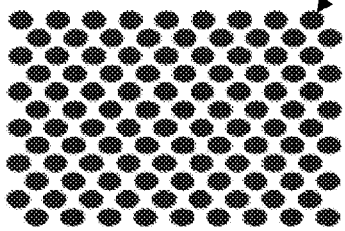
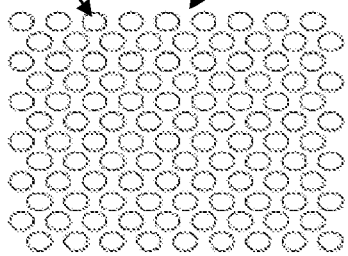
FIG. 1C
FIG. 1D
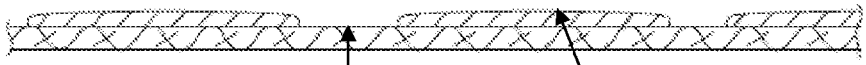
FIG. 1E
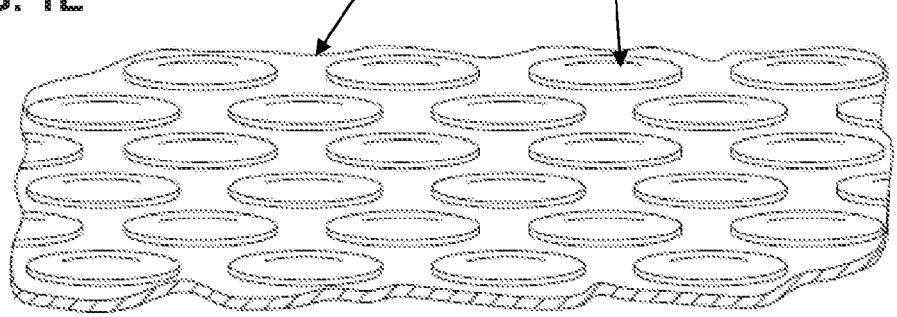

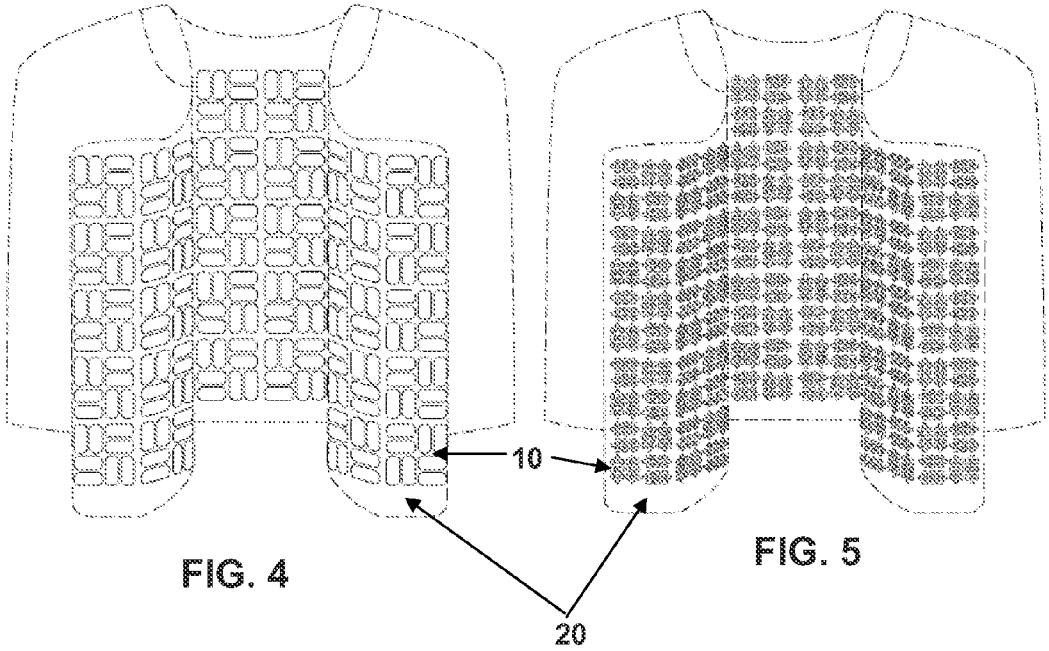
FIG. 4
FIG. 5
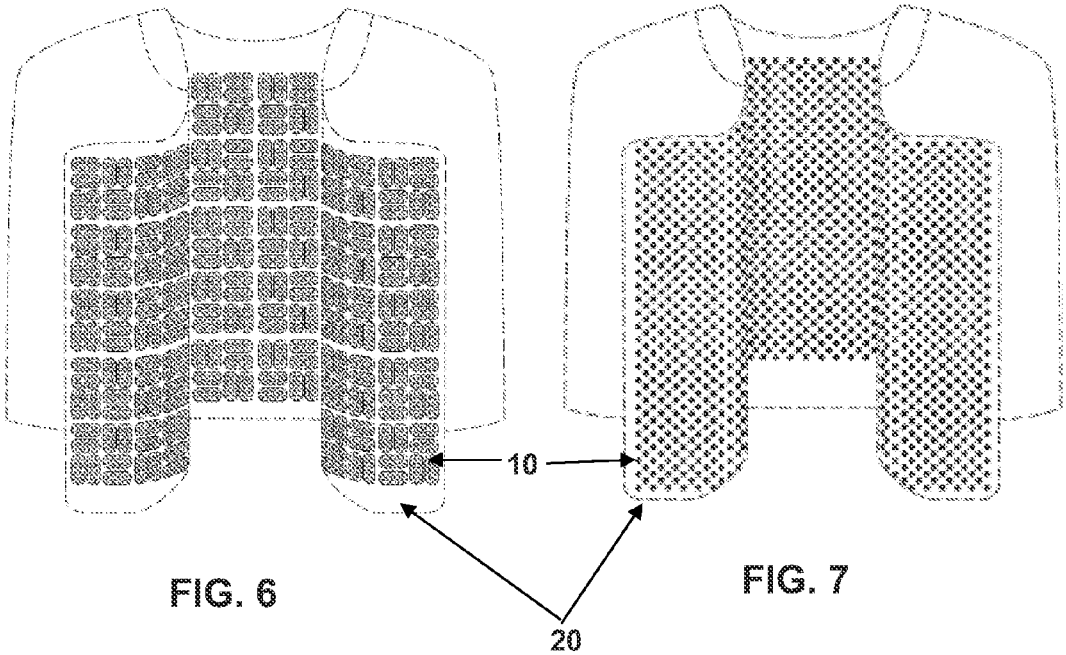
FIG. 6
FIG. 7

FIG. 8A
FIG. 8B
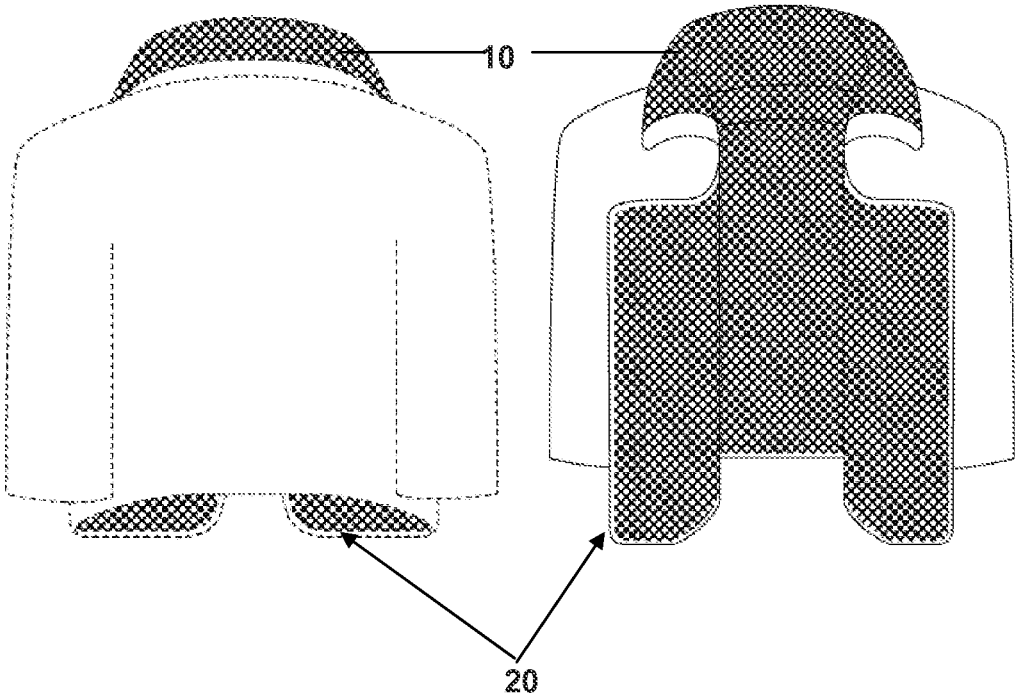
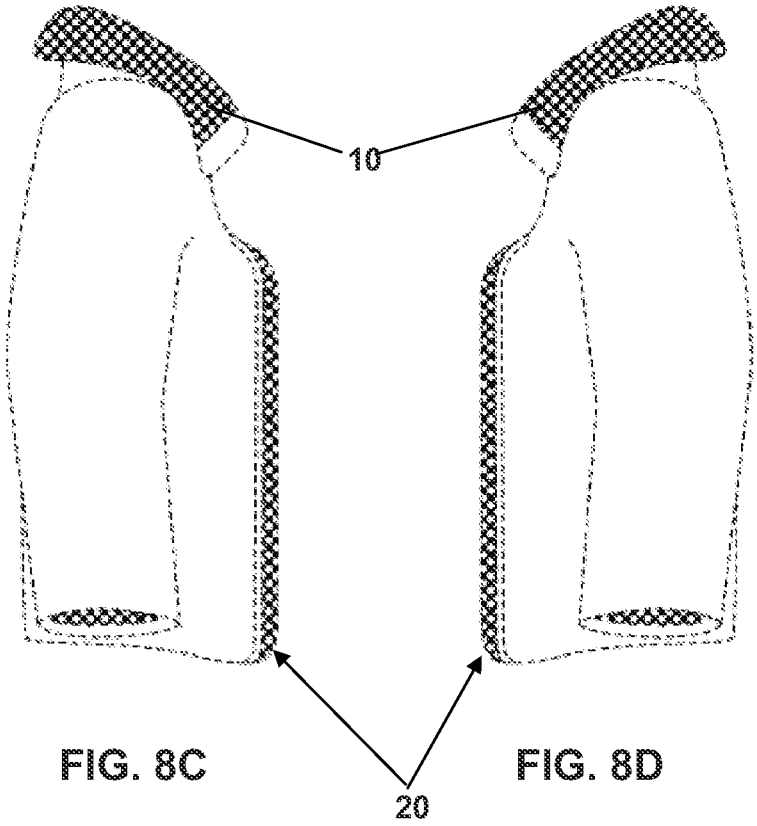
FIG. 8C
FIG. 8D

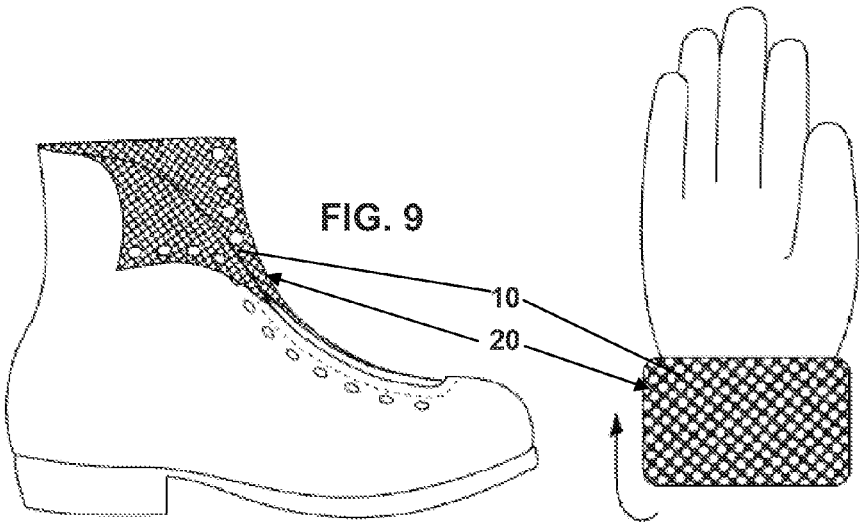
FIG. 9
FIG. 10
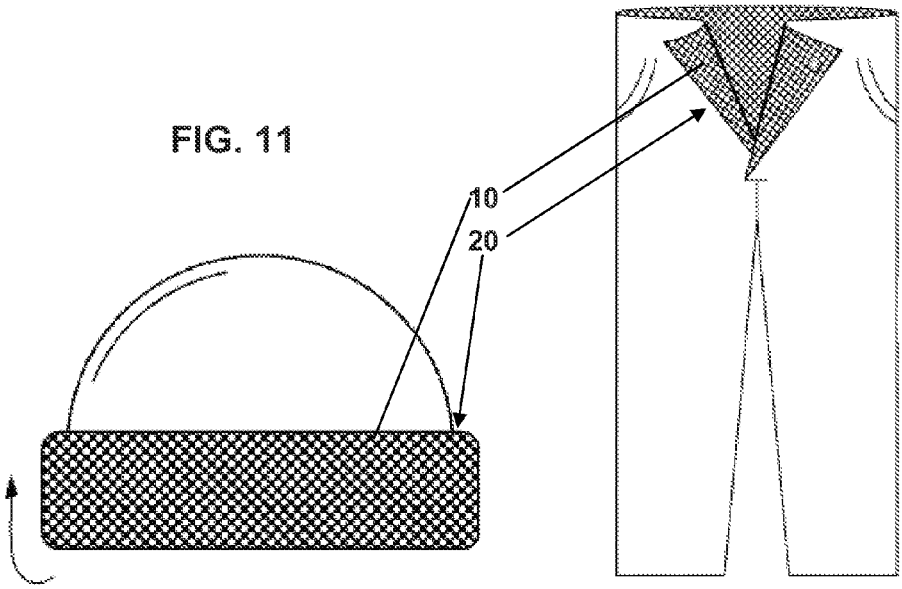
FIG. 11
FIG. 12

20
10

ZONED FUNCTIONAL FABRICS

CROSS-REFERENCE TO RELATED APPLICATION

This application is a continuation-in-part of and claims the benefit of the filing date of U.S. patent application Ser. No. 12/776,306, filed May 7, 2010, which in turn claims the benefit of the filing date of U.S. Provisional Application No. 61/176,448, filed May 7, 2009, the disclosures of both of which are incorporated herein in their entirety. This present application is also a continuation-in-part of and claims the benefit of the filing dates of U.S. Design Patent applications 29/385,768, filed in Feb. 18, 2011; 29/360,364, filed on Apr. 23, 2010; 29/346,787, filed on Nov. 5, 2009; 29/346,784, filed on Nov. 5, 2009; 29/346,785, filed on Nov. 5, 2009; 29/346,786, filed on Nov. 5, 2009; 29/346,788, filed on Nov. 5, 2009; and 29/336,730, filed on May 7, 2009, the disclosures of which are incorporated herein in their entirety.

TECHNICAL FIELD

Embodiments of the present disclosure relate generally to a fabric or other material used for apparel and other goods having designed performance characteristics, and in particular to methods and apparatuses that utilize a pattern of performance elements coupled to a base fabric to manage one or more performance characteristics while maintaining the desired properties of the base fabric.

BACKGROUND

Currently, fabric performance characteristic materials such as reflective materials, wicking materials, cooling materials, and the like typically take the form of uniform layers that are glued, woven, or otherwise attached to the interior of a garment, such as a jacket. The purpose of this layer may be to reflect body heat, enhance wicking, direct heat in an outward direction, or cool the body. However, these uniform layers have shortcomings. For example, a uniform layer of heat reflective material or cooling material may not transfer moisture vapor or allow air passage. Likewise, a wicking material may not insulate well or may not cool well. Furthermore, the performance characteristic materials may not have the desired characteristics of the base fabric, such as drape, stretch, and the like. Thus, the use of a layer of performance characteristic material may impede the breathability or other function of the underlying base fabric.

BRIEF DESCRIPTION OF THE DRAWINGS

Embodiments of the present disclosure will be readily understood by the following detailed description in conjunction with the accompanying drawings. Embodiments of the invention are illustrated by way of example and not by way of limitation in the figures of the accompanying drawings.

FIG. 1A illustrates an upper body garment such as a coat having a lining of base material with performance characteristic elements disposed thereon, in accordance with various embodiments;

FIGS. 1B-1E illustrate various views of examples of patterned performance characteristic elements disposed on a base fabric or material, in accordance with various embodiments;

FIG. 4 illustrates an upper body garment such as a coat having a lining of base material with performance characteristic elements disposed thereon, in accordance with various embodiments;

FIG. 5 illustrates an upper body garment such as a coat having a lining of base material with performance characteristic elements disposed thereon, in accordance with various embodiments;

FIG. 6 illustrates an upper body garment such as a coat having a lining of base material with performance characteristic elements disposed thereon, in accordance with various embodiments;

FIG. 7 illustrates an upper body garment such as a coat having a lining of base material with performance characteristic elements disposed thereon, in accordance with various embodiments;

FIGS. 8A-D illustrate various views of a patterned performance characteristic material as used in a jacket, in accordance with various embodiments;

FIG. 9 illustrates an example of a patterned performance characteristic material as used in a boot, in accordance with various embodiments;

FIG. 10 illustrates an example of a patterned performance characteristic material as used in a glove, where the cuff is rolled outward to show the lining, in accordance with various embodiments;

FIG. 11 illustrates an example of a patterned performance characteristic material as used in a hat, in accordance with various embodiments;

FIG. 12 illustrates an example of a patterned performance characteristic material as used in a pair of pants, in accordance with various embodiments;

DETAILED DESCRIPTION OF EMBODIMENTS

Figure 2A:
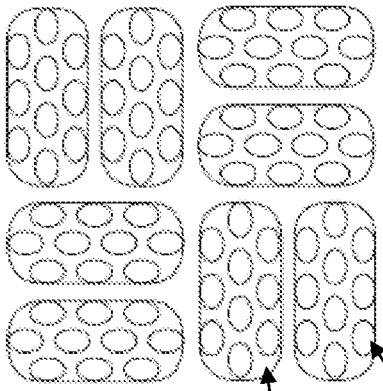
FIGS. 2A and 2B illustrate examples of patterned performance characteristic disposed on a base fabric, in accordance with various embodiments.
Figure 2B:
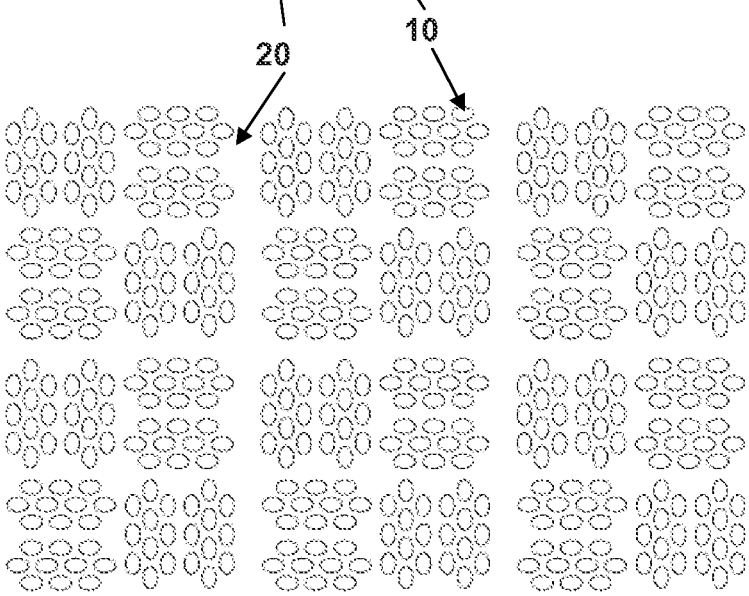
Figure 3A:
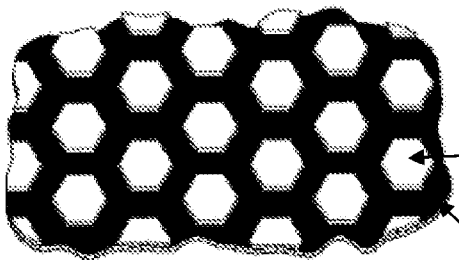
FIGS. 3A-3E illustrate examples of patterned performance characteristic elements disposed on a base fabric, in accordance with various embodiments.
Figure 3B:
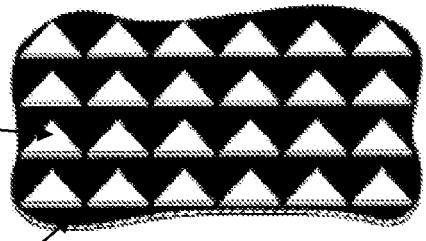
Figure 3C:
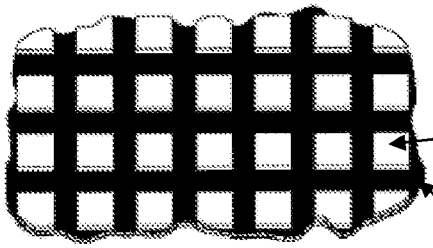
Figure 3E:
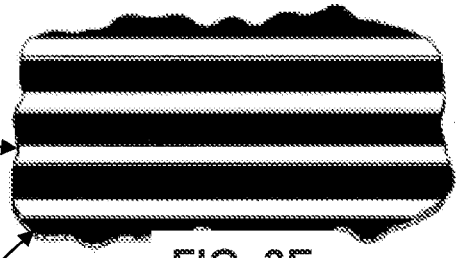
Figure 3D:
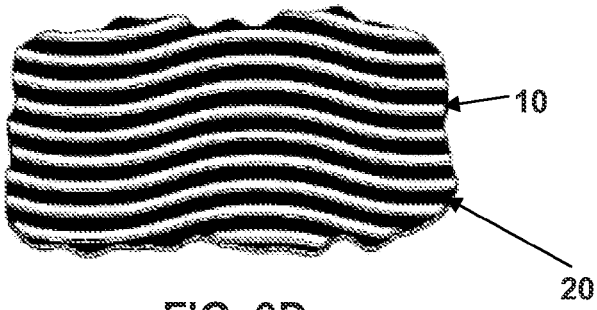

In the following detailed description, reference is made to the accompanying drawings which form a part hereof, and in which are shown by way of illustration embodiments in which the disclosure may be practiced. It is to be understood that other embodiments may be utilized and structural or logical changes may be made without departing from the scope of the present disclosure. Therefore, the following detailed description is not to be taken in a limiting sense, and the scopes of embodiments, in accordance with the present disclosure, are defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

In various embodiments a material for body gear is disclosed that may use a pattern of performance characteristic elements coupled to a base fabric to manage a performance characteristic, for example, heating, cooling, wicking, absorbance, or breathability, while still maintaining the desired properties of the base fabric. For example, referring to FIGS. 1B-1E, in one embodiment, a plurality of performance characteristic elements 10 may be disposed on a base fabric 20 in a generally non-continuous array, whereby some of the base fabric is exposed between adjacent performance characteristic elements. In various embodiments, the performance characteristic may include thermoregulation, breathability, wicking, absorbance, or a combination thereof, and these different performance characteristic elements may be positioned in different regions or zones of the body gear.

Although particular performance characteristics are described herein in various examples, one of skill in the art will appreciate that other performance characteristics may be substituted or used in combination. Additionally, the base fabric may include functional properties, such as abrasion resistance, anti-static properties, air permeability, anti-microbial activity, water repellence, flame repellence, hydrophilicity, hydrophobicity, wind resistance, UV protection, resiliency, stain resistance, wrinkle resistance, and the like.

In various embodiments, the performance characteristic elements 10 may cover a sufficient surface area of the base fabric 20 to generate the desired degree of the performance characteristic (e.g., heat reflection toward the body to enhance warmth, heat absorbance or conductance away from the body to help induce cooling, or wicking to prevent moisture accumulation). A sufficient area of base fabric may be exposed to provide the desired base fabric function (e.g., stretch, drape, breathability, moisture vapor or air permeability, wicking, etc.)

Figures 13, 14:
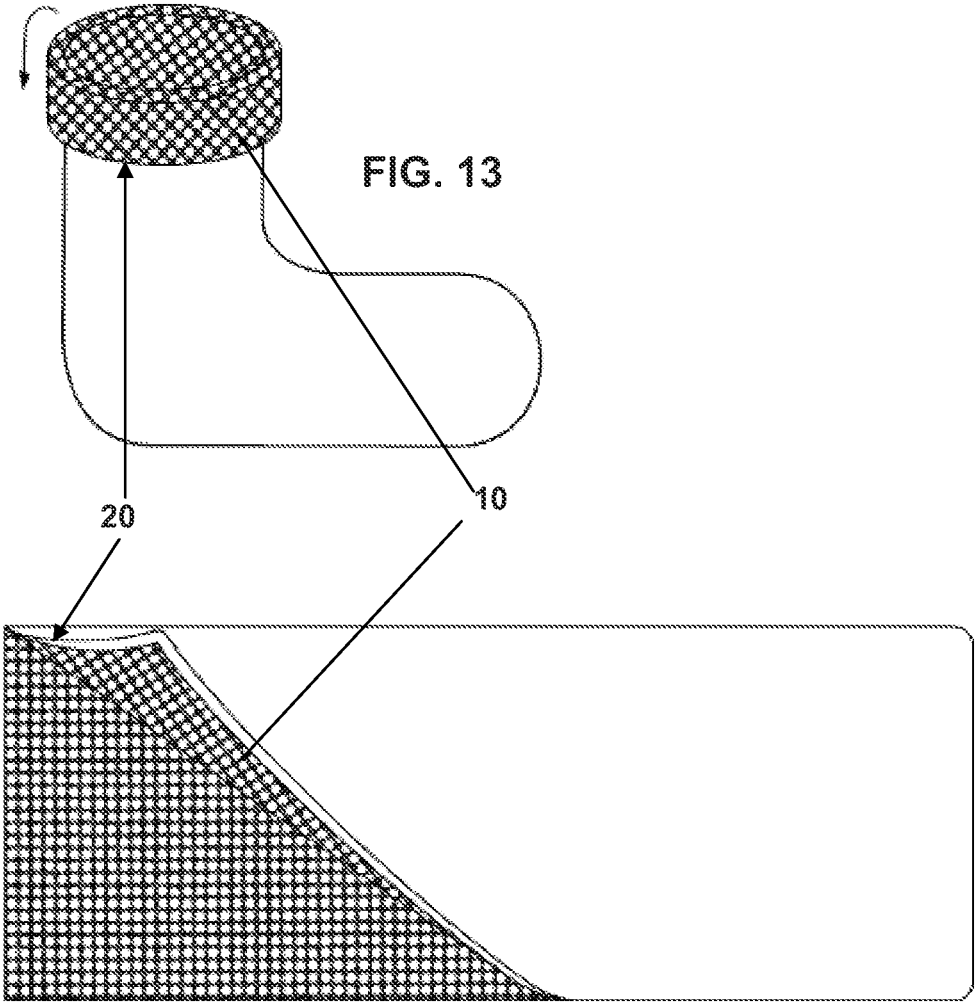
FIG. 13 illustrates an example of a patterned performance characteristic material as used in a sock, in accordance with various embodiments.
FIG. 14 illustrates an example of a patterned performance characteristic material as used in a boot, in accordance with various embodiments.

In accordance with various embodiments, the base fabric may be a part of any form of body gear, such as bodywear (see, e.g., FIGS. 1A and 4-13), sleeping bags (see, e.g., FIG. 14), blankets, tents (see, e.g., FIG. 15B), rain flys (see, e.g., FIG. 15A) etc. Bodywear, as used herein, is defined to include anything worn on the body, including, but not limited to, outerwear such as jackets, pants, scarves, shirts, hats, gloves, mittens, and the like, footwear such as shoes, boots, slippers, and the like, sleepwear, such as pajamas, nightgowns, and robes, and undergarments such as underwear, thermal underwear, socks, hosiery, and the like.

In various embodiments, single-layer body gear may be used and may be comprised of a single layer of the base fabric, whereas other embodiments may use multiple layers of fabric, including one or more layers of the base fabric, coupled to one or more other layers. For instance, the base fabric may be used as a fabric lining for body gear.

In various embodiments, the array of performance characteristic elements may be disposed on a base fabric having one or more desired properties. For example, the underlying base material may have properties such as air permeability, moisture vapor transfer, and/or wickability, which is a common need for body gear used in both indoor and outdoor applications. In other embodiments, the underlying base material may have properties such as stretch, drape, and breathability, and/or other functional characteristics).

In still other embodiments, the separations between performance characteristic elements may help allow the base material to have a desired drape, look, and/or texture. In some embodiments, the separations between heat-directing elements may help allow the base material to stretch. Suitable base fabrics may include nylon, polyester, rayon, cotton, spandex, wool, silk, or a blend thereof, or any other material having a desired look, feel, weight, thickness, weave, texture, or other desired property. In various embodiments, allowing a designated percentage of the base fabric to remain uncovered by the performance characteristic elements may allow that portion of the base fabric to perform the desired functions, while leaving enough performance characteristic element surface area to direct body heat in a desired direction, for instance away from or toward the body of a user.

The performance characteristic elements may perform any of a number of functions, such as directing heat, absorbing heat, emitting heat, and/or wicking moisture. For example, in some embodiments, the performance characteristic elements may be heat-directing elements positioned in such a way and made of a material that is conducive for directing heat generated by the body. In one embodiment, the heat-directing elements may be configured to reflect the user's body heat toward the user's body, which may be particularly suitable in cold environments. In another embodiment, the heat-directing elements may be configured to conduct the user's body heat away from the user's body, which may be particularly suitable in warmer environments. In particular embodiments, the heat-directing elements may be configured to generally reflect the user's body heat toward the user's body, but may also begin to conduct heat away from the user's body when the user begins to overheat. In other embodiments, the heat-directing elements may absorb excess heat to cool a user or body part, or emit heat to warm a user or body part. In still other embodiments, the performance characteristic elements may be moisture wicking elements positioned in such a way as to wick moisture, such as sweat, away from the body.

In various embodiments, the base fabric may include performance characteristic elements disposed on an innermost surface of the body gear such that the elements are disposed to face the user's body and thus are in a position to manage body heat or moisture, as discussed above (e.g., reflect heat or conduct heat or moisture). In some other embodiments, the performance characteristic elements may be disposed on the exterior surface of the body gear and/or base fabric such that they are exposed to the environment, which may allow the performance characteristic elements, for example, to reflect heat away from the user or increase breathability, while allowing the base fabric to adequately perform the desired functions. In some embodiments, the performance characteristic elements may perform these functions without adversely affecting the stretch, drape, feel, or other properties of the base fabric.

In some embodiments, more than one type of performance characteristic element may be used, such as a combination of two, three, four, or more types of performance characteristic elements. For example, in some embodiments, two, three, four, or more types of performance characteristic elements may be intermingled on a single base fabric, for example in a random or regular pattern, such that two, three, four, or more performance characteristics are exhibited by a fabric. In other embodiments, the two, three, four, or more types of performance characteristic elements may be located in different zones of the body gear.

In embodiments, multiple performance characteristic elements may be used on a given body gear, where such performance characteristic elements are located specifically in accordance with the desired function for that area/region.

For instance, in one specific, non-limiting example, heat-directing elements may be located on the torso or chest of an upper body garment such as a jacket (e.g., to direct heat towards the body), and wicking elements may be located in the armpit and upper chest regions (e.g., to prevent moisture buildup).

In another specific, non-limiting example, heat-emitting elements (e.g., to warm the body), may be located in the heel and toe regions of a sock, and wicking elements (e.g., to prevent moisture buildup) may be located in the midfoot and sole regions.

In another specific, non-limiting example, where the bodywear is a shirt, heat absorbing elements may be located generally on the torso, heat-reflecting elements may be generally located on the back and shoulders, and wicking elements may be strategically located in the armpit and upper back regions.

In another specific, non-limiting example, a tent may be provided with various moisture wicking and/or heat-directing zones depending on the intended climate in which the tent will be used In various embodiments, one of skill in the art will appreciate that the boundaries between adjacent zones may be distinct or may include blended transition zones. In some embodiments, the arrangement of two, three, four, or more different performance characteristic elements may vary gradually over the entire garment to suit a particular set of needs or uses. One of skill in the art also will appreciate that some areas of the garment may include no performance characteristic elements.

As described above, in some embodiments, the performance characteristic elements may perform a heat-directing function, either directing heat away from or toward the body. In these embodiments, the performance characteristic elements may include heat reflective elements, conductive elements, cooling elements, or a combination thereof. For example, in various embodiments, the heat reflective and/or conductive elements may include an aluminum-based material (particularly suited for reflectivity), chromium-based material (particularly suited for reflectivity), copper based material (particularly suited for conductivity), or another metal or metal alloy-based material. Non-metallic or alloy based materials may be used as heat-directing materials in some embodiments, such as metallic plastic, mylar, or other man-made materials, provided that they have heat reflective or conductive properties. In other embodiments, a heat-directing element may be a holographic heat-directing element, such as a holographic foil or embossed reflective surface.

In other embodiments, the performance characteristic elements may absorb heat. For example, in some embodiments, the performance characteristic elements may include a cooling polymer. In various embodiments, cooling polymers may include, for example, any suitable natural or synthetic polymeric material in a dry form that is capable of absorbing and storing many times its weight in water. Specific, non-limiting examples of natural gums that may be used as superabsorbent polymers include xanthan, guar, agar, pectin, gum arabic, locust bean gum, hydroxypropyl guar gum, polyglucomannan gum, cationic guar gum, anionic guar gum, alginate, irish moss, and gum arabic. Specific, non-limiting examples of cellulosics that may be used as superabsorbent polymers include methyl cellulose, ethyl cellulose, carboxymethyl cellulose, carboxy ethyl cellulose, hydroxyethyl cellulose, hydroxymethyl cellulose, and hydroxypropylcellulose. Specific, non-limiting examples of synthetic hydrogel polymers that may be used as superabsorbent include suitable crosslinked, water-swellable acrylic copolymers.

In particular embodiments, the synthetic hydrogel polymers may include, without limitation, copolymers that include repeat units from one or more monomers selected from (meth)acrylic acid, maleic acid, 2-(meth)acrylamido-2-methyl propane sulfonic acid, styrene sulfonate, vinyl sulfonic acid, and their corresponding ammonia, amine and alkali metal salts, (meth)acrylamide, vinyl alcohol, vinyl acetate, maleic anhydride, alkyl vinyl ethers, vinylmorpholinone, vinylpyrridine, vinyl pyrrolidone, and acrylonitrile; and one or more crosslinking agents selected from N,N'-methylenebis(meth)acrylamide, (poly)ethylene glycol di(meth)acrylate, (poly)propylene glycol di(meth)acrylate, trimethylolpropane tri(meth)acrylate, glycerol tri(meth)acrylate, glycerol acrylate methacrylate, ethylene-oxide-modified trimethylolpropane tri(meth)acrylate, pentaerythritol tetra (meth)acrylate, dipentaerythritol hexa(meth)acrylate, triallyl cyanurate, triallyl isocyanurate, triallyl phosphate, triallylamine, poly(meth)allyloxyalkanes, (poly)ethylene glycol diglycidyl ether, glycerol diglycidyl ether, ethylene glycol, polyethylene glycol, propylene glycol, glycerol, pentaerythritol, ethylenediamine, ethylene carbonate, propylene carbonate, polyethylenimine, glycidyl(meth)acrylate, diallyl sucrose, triallyl sucrose triallyl amine, and triallyl methyl ammonium chloride. Additional superabsorbent polymers and methods to manufacture such polymers are described, without limitation, in U.S. Pat. Nos. 6,469,080, 6,399,668, 6,127,454, 6,087,002, 5,244,735, 4,925,603, and 4,734,478. Additional non-limiting examples of superabsorbent polymers that may be used in performance characteristic elements include those available under the trade names ALCOSORB® from Ciba Specialty Chemicals, Chatanooga, Tenn.; DRYTECH® from the Dow Chemical Company, Midland, Mich.; NORSOCRYL® and AQUAKEEP® from Atofina, Paris, France; HYDROSORB™ from HYDROSORB Inc., Orange, Calif.; and AQUALIC CA from Nippon, Shokubai Co., Ltd., Osaka, Japan.

In other embodiments, the performance characteristic materials may absorb or emit heat, depending on the conditions. For example, in some embodiments, the performance characteristic elements may include a phase change material. Generally speaking, phase change materials may have the capability of absorbing or releasing thermal energy to reduce or eliminate heat transfer at the temperature stabilizing range of the particular phase change material. In various embodiments, the phase change material may inhibit or stop the flow of thermal energy through the coating during the time the phase change material is absorbing or releasing heat, typically during the material's change of phase. In various embodiments, this action may be transient, e.g., it may be effective as a barrier to thermal energy until the total latent heat of the temperature stabilizing material is absorbed or released during the heating or cooling process. In various embodiments, thermal energy may be stored or removed from the phase change material, and may be effectively recharged by a source of heat or cold. In various embodiments, by selecting an appropriate phase change material, a performance characteristic element may be created for use in a particular application where the stabilization of temperatures is desired. In various embodiments, two or more different phase change materials may be used to address particular temperature ranges, and such materials may be mixed.

In various embodiments, phase change materials that may be used as described herein generally include paraffinic hydrocarbons having 13 to 28 carbon atoms. In various embodiments, the melting point of a homologous series of paraffin hydrocarbons may be directly related to the number of carbon atoms as shown in the following table:

| Compound Name | Number of Carbon Atoms | Melting Point (° C.) |
|---|---|---|
| n-Octacosane | 28 | 61.4 |
| n-Heptacosane | 27 | 59.0 |
| n-Hexacosane | 26 | 56.4 |
| n-Pentacosane | 25 | 53.7 |
| n-Tetracosane | 24 | 50.9 |
| n-Tricosane | 23 | 47.6 |
| n-Docosane | 22 | 44.4 |
| n-Heneicosane | 21 | 40.5 |
| n-Eicosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetradecane | 14 | 5.9 |
| n-Tridecane | 13 | −5.5 |

In other embodiments, the performance characteristic elements may wick moisture, such as water or water vapor, away from the skin surface of a user. For example, in some embodiments, the performance characteristic elements may include a carbon fiber or mineral fiber, or a carbon or mineral-based fabric coating to enhance wicking. Generally speaking, carbon or mineral fabrications may blend carbon-infused fibers or particles and/or mineral-infused fibers or particles with other yarns or fibers to create a wicking fabric. In various embodiments, performance characteristic elements that wick moisture also may have anti-bacterial and/or anti-fungal properties, and may be deodorizing and/or breathable, in addition to moisture wicking.

In various embodiments, the performance characteristic elements may be applied in a pattern or a continuous or discontinuous array defined by the manufacturer. For example, as illustrated in FIGS. 1A-1E, performance characteristic elements 10, may be a series of dot-like elements with one or more desired performance characteristics that may be adhered or otherwise secured to the base fabric 20 in a desired pattern. Such a configuration has been found to provide the desired performance characteristics, while still allowing the base fabric to perform the function of the desired one or more properties (e.g. breathe and allow moisture vapor to escape through the fabric in order to reduce the level of moisture build up, insulate, or have a particular desired drape, look, or feel).

Although the illustrated embodiments show the performance characteristic elements as discrete elements, in some embodiments, some or all of the heat-directing elements may be arranged such that they are in connection with one another, such as a lattice pattern or any other pattern that permits partial coverage of the base fabric.

In various embodiments, the configuration or pattern of the performance characteristic elements themselves may be selected by the user and may take any one of a variety of forms. For example, as illustrated in FIGS. 2A-2B, 3A-3E, and 4-6, the configuration of performance characteristic elements 10 disposed on a base fabric 20 used for body gear may be in the form of a variety of geometrical patterns (e.g. lines, waves, triangles, squares, logos, words, etc.)

In various embodiments, the pattern of performance characteristic elements may be symmetric, ordered, random, and/or asymmetrical. Further, as discussed below, the pattern of performance characteristic elements may be disposed on the base material at strategic locations to improve the performance of the body gear. In various embodiments, the size of the performance characteristic elements may also be varied to balance the need for enhanced performance characteristics and preserve the functionality of the base fabric.

In various embodiments, the density or ratio of the surface area covered by the performance characteristic elements to the surface area of base fabric left uncovered by the performance characteristic elements may be from about 3:7 (30% coverage) to about 7:3 (70% coverage). In various embodiments, this range has been shown to provide a good balance of performance characteristic properties (e.g., heat management or wicking) with the desired properties of the base fabric (e.g., breathability, insulation, or wicking, for instance). In particular embodiments, this ratio may be from about 4:6 (40% coverage) to about 6:4 (60% coverage).

In various embodiments, the placement, pattern, and/or coverage ratio/percentage of the performance characteristic elements may vary. For example the performance characteristic elements may be concentrated in certain areas where heat management or wicking may be more critical (e.g., the body core) and non existent or extremely limited in other areas where the function of the base fabric property is more critical (e.g., areas under the arms or portions of the back for wicking moisture away from the body). In various embodiments, different areas of the body gear may have different coverage ratios, e.g. 70% at the chest and 30% at the limbs, in order to help optimize, for example, the need for warmth and breathability. In other embodiments, different performance characteristic elements may be used in different areas, for instance heat-directing elements in the body core regions and wicking elements under the arms or on portions of the back, for example. In various embodiments, two, three, or more different performance characteristic elements may be combined in a single article, and coverage of each performance characteristic element may be customized according to the particular needs of the user.

In various embodiments, the size of the performance characteristic elements may be largest (or the spacing between them may be the smallest) in the core regions of the body for enhanced heat reflection, conduction, absorbance, or emission, or enhanced wicking and breathability in those areas, and the size of the performance characteristic elements may be the smallest (or the spacing between them may be the largest) in peripheral areas of the body. In some embodiments, the degree of coverage by the performance characteristic elements may vary in a gradual fashion over the entire article as needed for regional heat and/or moisture management. Some embodiments may employ heat reflective elements in some areas and heat conductive elements in other areas of the article, or heat-absorbing elements in some areas and heat emitting elements in other areas.

In various embodiments, the performance characteristic elements may be configured to help resist moisture buildup on the performance characteristic elements themselves and further enhance the function of the base fabric (e.g., breathability, insulation, or moisture wicking, for instance). In one embodiment, it has been found that reducing the area of individual elements, but increasing the density may provide a better balance between performance characteristic and base fabric functionality, as there will be a reduced tendency for moisture to build up on the performance characteristic elements. In some embodiments, it has been found that keeping the surface area of the individual performance characteristic elements below 1 $cm^2$ may help to reduce the potential for moisture build up. In various embodiments, the performance characteristic elements may have a largest dimension (diameter, hypotenuse, length, width, etc.) that is less than or equal to about 1 cm. In some embodiments, the largest dimension may be between 1-4 mm. In other embodiments, the largest dimension of a performance characteristic element may be as small as 1 mm, or even smaller. In some embodiments, the size and shape of the performance characteristic elements may be selected to display a logo, company name, picture, or other insignia.

In some embodiments, the topographic profile of the individual performance characteristic elements may be such that moisture is not inclined to adhere to the performance characteristic element. For example, the performance characteristic elements may be convex, conical, fluted, or otherwise protruded, which may help urge moisture to flow toward the base fabric. In some embodiments, the surface of the performance characteristic elements may be treated with a compound that may help resist the build-up of moisture vapor onto the elements and better direct the moisture to the base fabric without materially impacting the performance characteristic properties. One such example treatment may be a hydrophobic fluorocarbon, which may be applied to the elements via lamination, spray deposition, or in a chemical bath.

In various embodiments, the performance characteristic elements may be removable from the base fabric and reconfigurable if desired using a variety of releasable coupling fasteners such as zippers, snaps, buttons, hook and loop type fasteners (e.g. Velcro), and other detachable interfaces. Further, the base material may be formed as a separate item of body gear and used in conjunction with other body gear to improve thermal management of a user's body heat. For example, an upper body under wear garment may be composed with heat-directing elements in accordance with various embodiments. This under wear garment may be worn by a user alone, in which case conduction of body heat away from the user's body may typically occur, or in conjunction with an insulated outer garment which may enhance the heat reflectivity of the user's body heat.

In various embodiments, the performance characteristic elements may be applied to the base fabric such that it is depressed, concave, or recessed relative to the base fabric, such that the surface of the heat-directing element is disposed below the surface of the base fabric. This configuration may have the effect of improving, for example, moisture wicking, as the base fabric is the portion of the body gear or body gear lining that engages the user's skin or underlying clothing. Further, such contact with the base fabric may also enhance the comfort to the wearer of the body gear in applications where the skin is in direct contact with the base fabric (e.g. gloves, mittens, underwear, or socks).

Figure 16A:
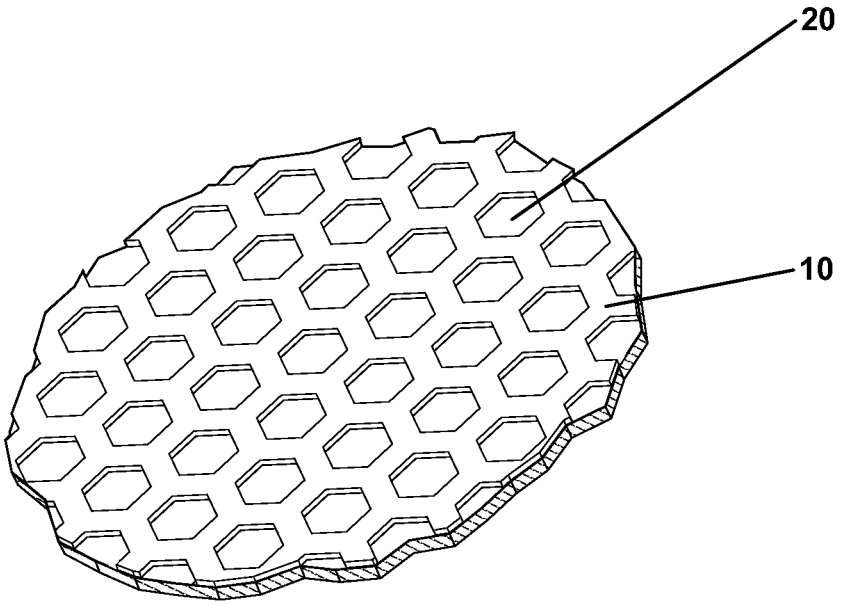
FIGS. 16A and 16B illustrate another example of patterned performance characteristic elements disposed on a base fabric or material in a perspective view (FIG. 16A), and in use in a jacket lining (FIG. 16B), in accordance with various embodiments.
Figure 16B:
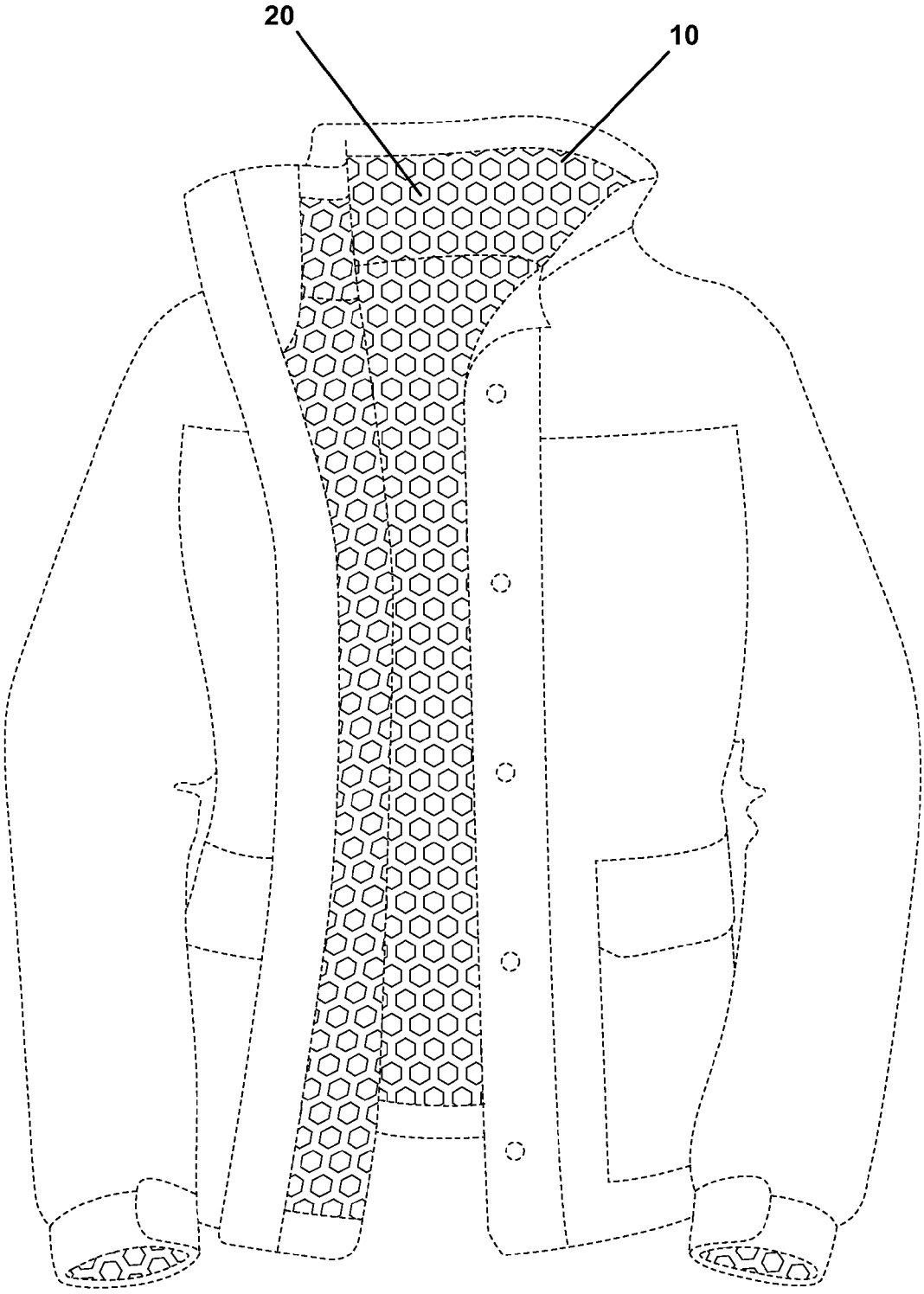

In various embodiments, performance characteristic elements may be configured in an inverse pattern from that shown in FIG. 1, with the performance characteristic elements forming a lattice or other interconnected pattern, with base fabric appearing as a pattern of dots or other shapes. For example, FIGS. 16A and 16B illustrate a lattice-pattern of performance characteristic elements disposed on a base fabric or material in a perspective view (FIG. 16A), and in use in a jacket lining (FIG. 16B), in accordance with various embodiments. Although a lattice pattern is illustrated, one of skill in the art will appreciate that any pattern or combination of patterns may be employed.

Figures 15A, 15B:
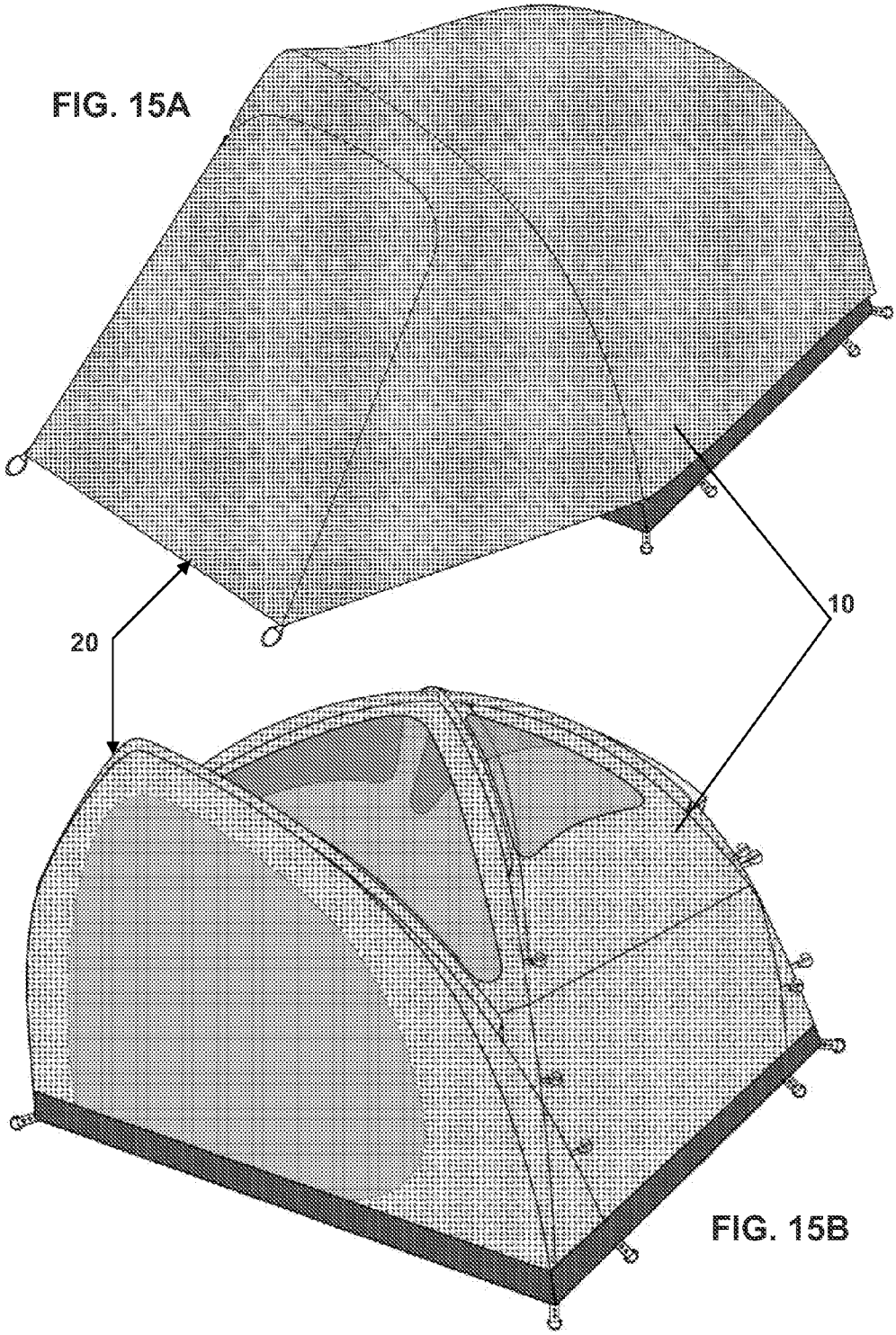
FIGS. 15A and B illustrate two views of a patterned performance characteristic material as used in a reversible rain fly (FIG. 15A) and as a portion of a tent body (FIG. 15B), in accordance with various embodiments.

FIGS. 8-15 illustrate various views of a patterned performance characteristic fabric used in a variety of body gear applications, such as a jacket (FIGS. 8A-D), boot (FIG. 9), glove (FIG. 10), hat (FIG. 11), pants (FIG. 12), sock (FIG. 13), sleeping bag (FIG. 14), tent rain fly (FIG. 15A) and tent (FIG. 15B). Each of the body gear pieces illustrated includes a base material 20 having a plurality of performance characteristic elements 10 disposed thereon.

While the principle embodiments described herein include performance characteristic elements that are disposed on the inner surface of the base fabric, in various embodiments, the performance characteristic elements may be used on the outside of body gear, for instance to reflect or direct heat exposed to the outside surface of the gear. For instance, in some embodiments, base fabric and performance characteristic elements, such as those illustrated in FIGS. 1B-3E, may be applied to an outer or exterior surface of the body gear, such as a coat, sleeping bag, tent or tent rain fly, etc. in order to reflect heat away from the user.

In some embodiments, the body gear may be reversible, such that a user may determine whether to use the fabric to direct the performance characteristic toward the body or away from the body. An example of such reversible body gear is illustrated in FIG. 15A. In this embodiment, the performance characteristic elements may be included on one side of a tent rain fly. In one embodiment, the rain fly may be used with the performance characteristic elements facing outward, for example in hot weather or sunny conditions, in order to reflect or direct heat away from the body of the tent user. Conversely, in cold weather conditions, for example, the tent rain fly may be reversed and installed with the performance characteristic elements facing inward, toward the body of a user, so as to reflect or direct body heat back toward the tent interior. Although a tent rain fly is used to illustrate this principle, one of skill in the art will appreciate that the same concept may be applied to other body gear, such as reversible jackets, coats, hats, and the like. FIG. 15B illustrates an example wherein at least a portion of the tent body includes a fabric having a plurality of performance characteristic elements disposed thereon. In the illustrated embodiment, the performance characteristic elements are facing outward and may be configured to reflect heat or moisture away from the tent and thus away from the body of the tent user. In other embodiments, the elements may be configured to face inward.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

We claim the following:

1. A performance characteristic material adapted for use with body gear, comprising:

a base material having a transfer property that is adapted to allow passage of moisture and/or water vapor through the base material;

a first array of first performance characteristic elements coupled to a first side of the base material, the first performance characteristic elements being adapted to perform a first function, wherein the first function comprises absorbing heat, emitting heat, wicking moisture, or a combination thereof; and a second array of second performance characteristic elements coupled to a the base material, the second performance characteristic elements being adapted to perform a second function, wherein the second function is different from the first function.

2. The performance characteristic material of claim 1, wherein the placement and spacing of the first performance characteristic elements enables the base material to perform the transfer property.

3. The performance characteristic material of claim 1, wherein the first performance characteristic elements comprise a cooling polymer, a phase change material, a mineral fiber, and/or a carbon fiber or particle.

4. The performance characteristic material of claim 1, wherein the function comprises reflecting heat, absorbing heat, emitting heat, wicking moisture, or a combination thereof.

5. The performance characteristic material of claim 1, wherein the material further comprises a third array of third performance characteristic elements.

6. The performance characteristic material of claim 1, wherein the second performance characteristic elements comprise a heat-directing element, a cooling polymer, a phase change material, a mineral fiber, and/or a carbon fiber or particle.

7. The performance characteristic material of claim 1, wherein the base material is a moisture-wicking fabric.

8. The performance characteristic material of claim 1, wherein the base material comprises one or more insulating or waterproof materials.

9. The performance characteristic material of claim 1, wherein the surface area ratio of performance characteristic elements to base material is from about 7:3 to about 3:7.

10. The performance characteristic material of claim 1, wherein the surface area ratio of first performance characteristic elements to base material is from about 3:2 to about 2:3.

11. The performance characteristic material of claim 1, wherein the first and second arrays are located in different zones of the body gear.

12. The performance characteristic material of claim 5, wherein the third array is configured to perform a third function, wherein the third function comprises absorbing heat, emitting heat, wicking moisture, or a combination thereof; and wherein the third function is different from the first and second functions.

13. The performance characteristic material of claim 1, wherein the first performance characteristic elements have a maximum spacing of less than about 1 cm.

14. The performance characteristic material of claim 1, wherein the first performance characteristic elements have a minimum spacing of more than about 1 mm.

15. The performance characteristic material of claim 1, wherein the material is part of a coat, jacket, shoe, boot, slipper, glove, mitten, hat, scarf, pants, sock, tent, rain fly, or sleeping bag.

16. A method of making a performance characteristic body gear material, comprising:

coupling a first array of first performance characteristic elements to a base material having a transfer functionality that is adapted to allow passage of moisture and/or water vapor through the base material, the first performance characteristic elements being adapted to perform a first function, wherein the first function comprises absorbing heat, emitting heat, wicking moisture, or a combination thereof;

coupling a second array of second performance characteristic elements to the base material, the first performance characteristic elements being adapted to perform a second function, wherein the second function is different from the first function;

pairing the performance characteristic body gear material with a piece of body gear; and positioning the first array in the body gear to perform the first function in a first desired region of the body gear.

17. The method of claim 16, wherein coupling the first performance characteristic elements comprises coupling performance characteristic elements of a size and spacing to cover from about 30% to about 70% of the base material.

18. The method of claim 16, wherein coupling the first performance characteristic elements comprises coupling performance characteristic elements such that there is a spacing of between about 2 mm and 1 cm between adjacent elements.

19. The method of claim 16, wherein the first performance characteristic elements comprise a cooling polymer, a phase change material, a mineral fiber, and/or a carbon fiber or particle.

20. The method of claim 16, wherein the second function comprises reflecting heat, absorbing heat, emitting heat, wicking moisture, or a combination thereof; and wherein the method further comprises positioning the second array in the body gear to perform the second function in a second desired region of the body gear.

21. The method of claim 20, wherein the second performance characteristic elements comprise a reflective element, a cooling polymer, a phase change material, a mineral fiber, and/or a carbon fiber or particle.

22. The method of claim 20, further comprising coupling a third array of third performance characteristic elements to the base material, the third performance characteristic elements being adapted perform a third function, wherein the third function comprises reflecting heat, absorbing heat, emitting heat, wicking moisture, or a combination thereof; and positioning the third array in the body gear to perform the third function in a third desired region of the body gear, wherein the third function is different from the first and second functions.

* * * * *